US008176964B2

(12) United States Patent
Janach

(10) Patent No.: US 8,176,964 B2
(45) Date of Patent: May 15, 2012

(54) CURTAIN SYSTEM COMPRISING SEVERAL FLAT PANELS

(75) Inventor: Walter E. Janach, Meggen (CH)

(73) Assignee: Hinno AG, Meggen (CH)

( * ) Notice: Subject to any disclaimer, the term of this patent is extended or adjusted under 35 U.S.C. 154(b) by 1451 days.

(21) Appl. No.: 10/561,562

(22) PCT Filed: Nov. 19, 2003

(86) PCT No.: PCT/CH03/00764

§ 371 (c)(1),
(2), (4) Date: Sep. 17, 2010

(87) PCT Pub. No.: WO2004/048738

PCT Pub. Date: Jun. 10, 2004

(65) Prior Publication Data

US 2011/0005693 A1 Jan. 13, 2011

(30) Foreign Application Priority Data

Nov. 25, 2002 (CH) ..... 1976/02

(51) Int. Cl.
*E06B 9/36* (2006.01)

(52) U.S. Cl. ..... 160/197; 160/168.1 V

(58) Field of Classification Search ..... 160/168.1 V, 160/900, 172 V, 197, 202, 178.1 V, 173 V, 160/236; 16/87.4 R, 95 D
See application file for complete search history.

(56) References Cited

U.S. PATENT DOCUMENTS 2,604,159 A * 7/1952 Wright ..... 160/172 R
3,125,154 A * 3/1964 Woodle ..... 160/178.1 V
3,280,891 A * 10/1966 Eldredge, Jr. et al. .... 160/172 R
3,298,425 A * 1/1967 Cayton et al. ..... 160/176.1 V
3,348,603 A * 10/1967 Ford ..... 160/197
3,911,991 A * 10/1975 Malferrari ..... 160/202
4,115,898 A * 9/1978 Frentzel ..... 16/87 R
4,221,255 A * 9/1980 Barkemeyer ..... 160/197
4,291,738 A * 9/1981 Grenga et al. ..... 160/176.1 R
4,998,577 A * 3/1991 Kobayashi et al. ..... 160/202
5,109,910 A * 5/1992 Tortorella et al. ..... 160/197
5,168,913 A * 12/1992 Haines ..... 160/168.1 R
5,720,331 A * 2/1998 Antonetti ..... 160/168.1 V

FOREIGN PATENT DOCUMENTS

DE 29 20 240 A1 9/1980

* cited by examiner

*Primary Examiner* — David Purol
(74) *Attorney, Agent, or Firm* — Edwin D. Schindler

(57) ABSTRACT

A curtain system includes several flat panels made of curtain fabric or other planar materials. The top of each flat panel is provided with a horizontal metal, wood or plastic horizontal slat on which the curtain fabric or flat panel hangs in a loose manner. Both ends of the horizontal slat include a fastening device for rollers or sliders. The rollers or sliders at one end of each horizontal slat are guided inside a first common track, while the rollers or sliders located on the other end of each horizontal slat are guided inside a second common track, such that the flat panels can be slid on top of each other. The flat panels extend at an acute angle relative to the first and second common tracks and can be slid on top of each other until the flat panels nearly overlap when the first and second common tracks are mounted parallel to each other, because the fastening device therefore is designed so that the fastening device does not laterally protrude from the horizontal slat or the alignment thereof.

16 Claims, 5 Drawing Sheets

CURTAIN SYSTEM COMPRISING SEVERAL FLAT PANELS

BACKGROUND OF THE INVENTION

1. Technical Field of the Invention

Figure 1:
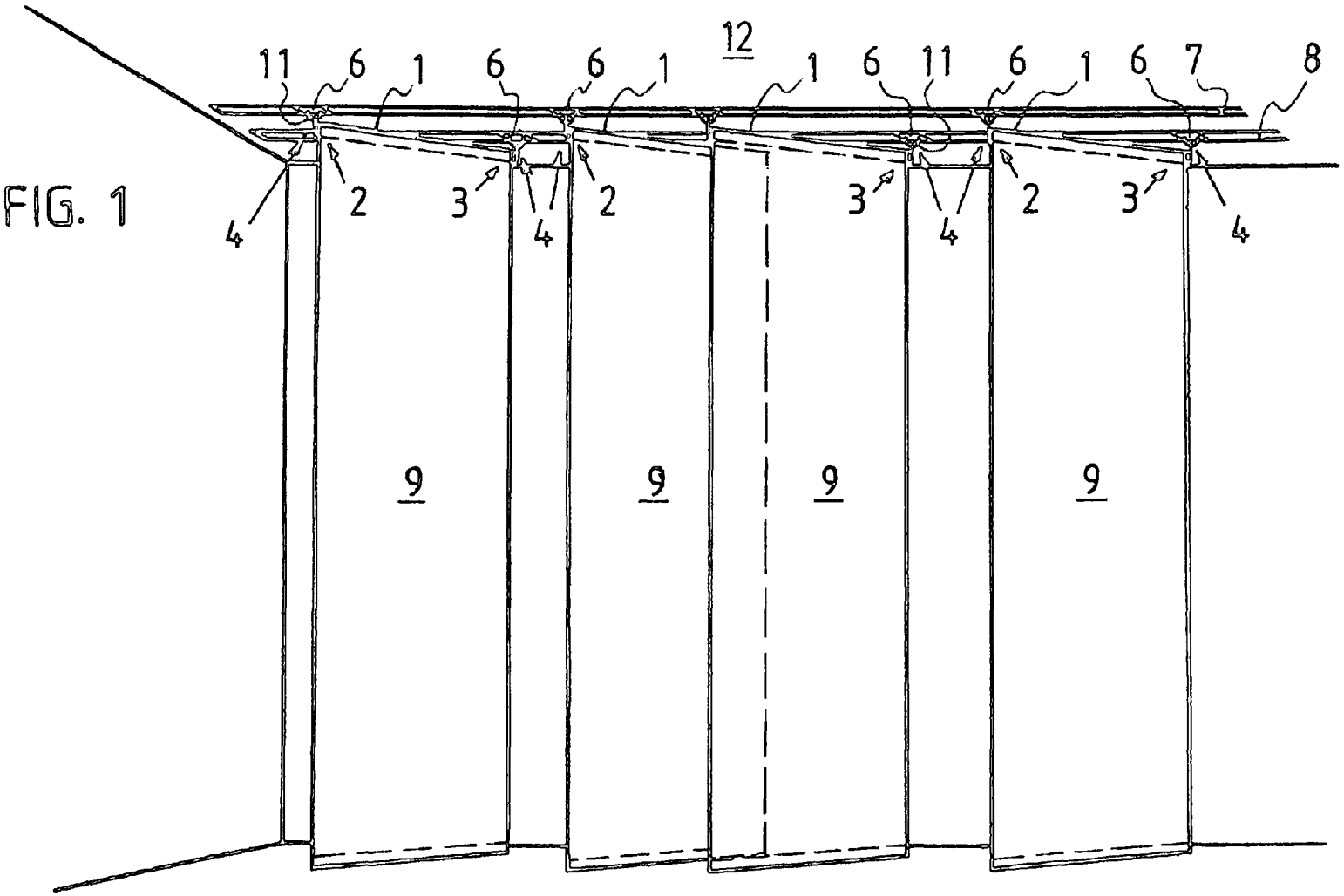

This invention relates to a curtain system for hanging up curtains of flat panels, for example of curtain material. Modern living is setting increased demands on curtain systems. With the application of flat curtain systems, thus those with which the curtain material no longer hangs in a serpentine manner, but forms flat elements or panels, more light may get into a room and other optical effects and in particular a modern ambience may be achieved. The curtains indeed not only serve for preventing someone looking into the house from the outside, but also as essentially elements of style which convey warmth and ambience and are to give the impression of a special flair. With rooms which are flooded with light with large window fronts, the curtains are preferably pulled over the whole width of the room. Despite this, such sheet curtains when required may be pushed to the side in order to be able to open a window or seat doors, or very simply in order to clear the view to the outside or to ensure a favourable incidence of light. With the known curtain systems for flat panels one differentiates between those with which the curtain material is fixed in a rectangular frame and those with which the panels of mainly flat pieces of textile hang freely from a carriage which is hung in rail runners of a curtain rail and is displaceable along these. This panel carriage for this is hung and guided with at least two sliders or rollers in a curtain rail, which as a rule is assembled parallel to the window. Since the panels on a single curtain rail, that is to say on a single rail runner, do not cross one another and thus may not overlap one another, but in the most favourable case may be pushed onto one another, as a rule a separate curtain rail or a separate rail run is required and laid for each panel. With a panel width of for example 0.5 metres and a surface width of 3.50 meters to be covered, then at least seven rail runs are required in order to cover this surface at every location with a curtain panel, unless one stacks the panels individually to the left and right of the window which however is disadvantageous. If at one or more locations an overlapping is yet to be achieved, then eight or even more rail runs are required. The assembly of these curtain rails with several rail runs on the one hand is quite strenuous and complicated as indeed is every assembly on the ceiling. On account of the large width, rails with a multitude of rail runs may also create a space problem and rails with many rail runs are accordingly expensive. Furthermore rails with many rail runs on a ceiling look bulky and destroy the simplicity which the sheet curtain system is to irradiate.

2. Description of the Prior Art

Sheet curtain systems have become known which make do with one rail with only two parallel rail runs. The associated carriages are then hung into the first rail run in the region of the one end at their upper side, and in the region of the other end are hung into the second rail run at their upper side. The known designs however act in a bulky manner since the panels when they are pushed together to one side form a thick stack. If the two curtain rail runs lie relatively close to one another, the individual carriages run at a very acute angle to these and they may be pushed together in an only partly overlapping manner. The carriages of the conventional systems before laying the rails on the ceiling of the room must be introduced into their rail runs and subsequently may no longer be moved out of the rail runs. For this reason the curtains may not be pushed over such a carriage with a hollow seam, otherwise they would no longer be capable of being removed from it for the purpose of washing. The carriages therefore on their one longitudinal side are provided with a Velcro strip to which the curtain material of an associated curtain panel may be pressed by way of a Velcro strip sewed onto the edge of the material. For washing the curtain material, the individual curtain panel material may be torn from the carriage amid the release of the Velcro closure, and after washing may be pressed onto the carriage again. However it has been shown that the Velcro strips after a few washing procedures no longer hang in a firm manner so that the holding force is reduced and the associated curtain panel no longer comes into place in a nice and level manner.

As a whole the existing sheet curtain systems are not completely convincing for various technical reasons. Firstly their assembly is expensive. Secondly these curtain panels act in a bulky manner since the associated carriages due to their design are relatively thick, and the panels form a thick stack, in particular when moving the panels together on one window side, which has a particularly negative effect if the two curtain rail runs are distanced relatively little from one another. Then specifically the individual panels may be pushed together overlapping only in a limited manner. Thirdly the manufacture of these sheet curtain systems is too expensive on account of the expensive design with Velcro strips. Finally the removal of the carriage once assembled is hardly possible with conventional systems without having to disassemble the rail runs.

SUMMARY OF THE INVENTION

It is therefore the object of the present invention to specify a curtain system which consists of several flat panels such as of curtain material or other laminar material and which alleviates the cited disadvantages. At the same time the curtain system in particular is to allow the associated hanger rods to be able to removed from the curtain rails at any time and in a simple manner.

This object is achieved by a curtain system with several flat panels of a sheet material, wherein each panel at the top comprises a hanger rod in the form of a horizontal slat of metal wood or plastic on which the sheet material hangs freely at hollow seams, and this slat is provided with fastening means for rollers or sliders, wherein the rollers or sliders of the one end region of each slat are guided in a first common rail and the rollers or sliders of the other end regions of each slat in a second common rail so that the panels may be sled over one another, and which is characterised in that the slats comprise recesses, holes or grooves which open into the end-face, and the fastening means are designed as insert elements which from the end-face or from the side may be inserted or applied into these recesses, holes or grooves in the slat.

BRIEF DESCRIPTION OF THE DRAWING FIGURES

The curtain system is represented by way of various exemplary views in drawings. It is described in more detail and its functioning is explained and described by way of these drawings.

Figure 2:
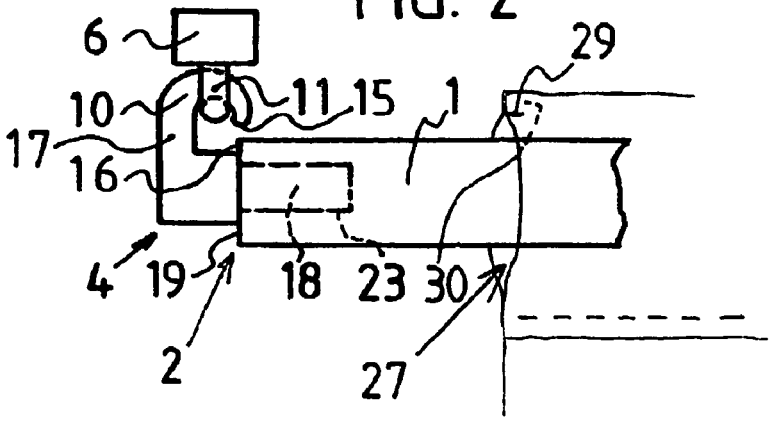
Figure 3:
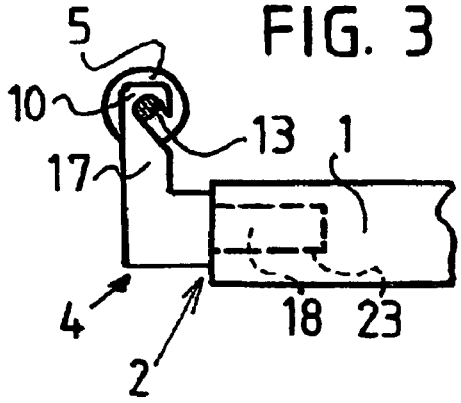
Figure 4:
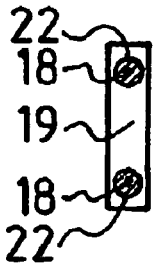
Figure 11:
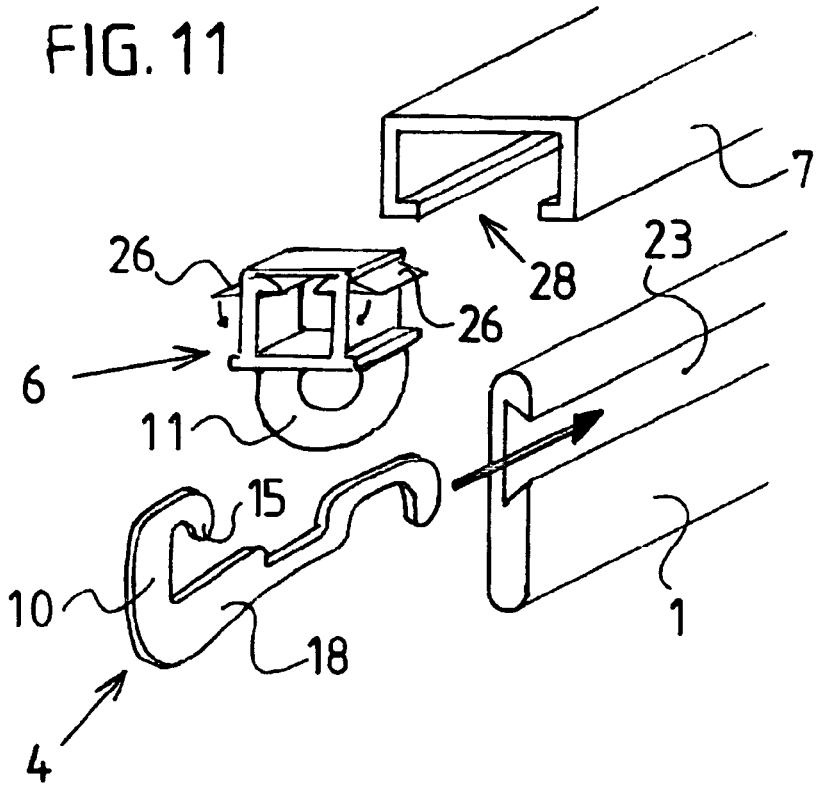
Figure 12:
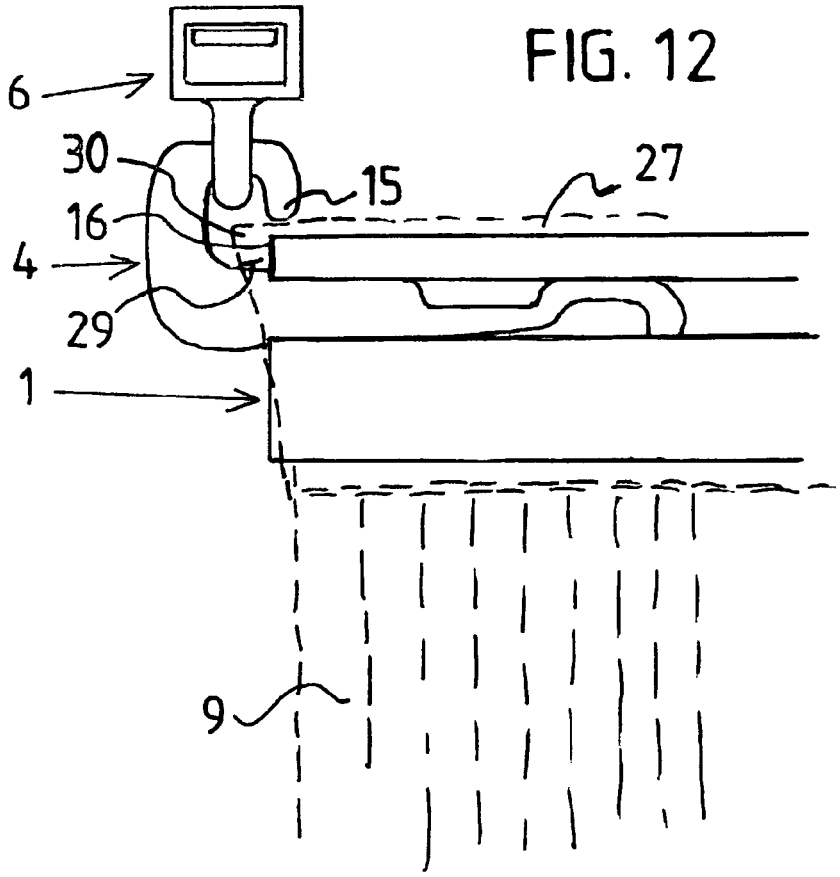
Figure 13:
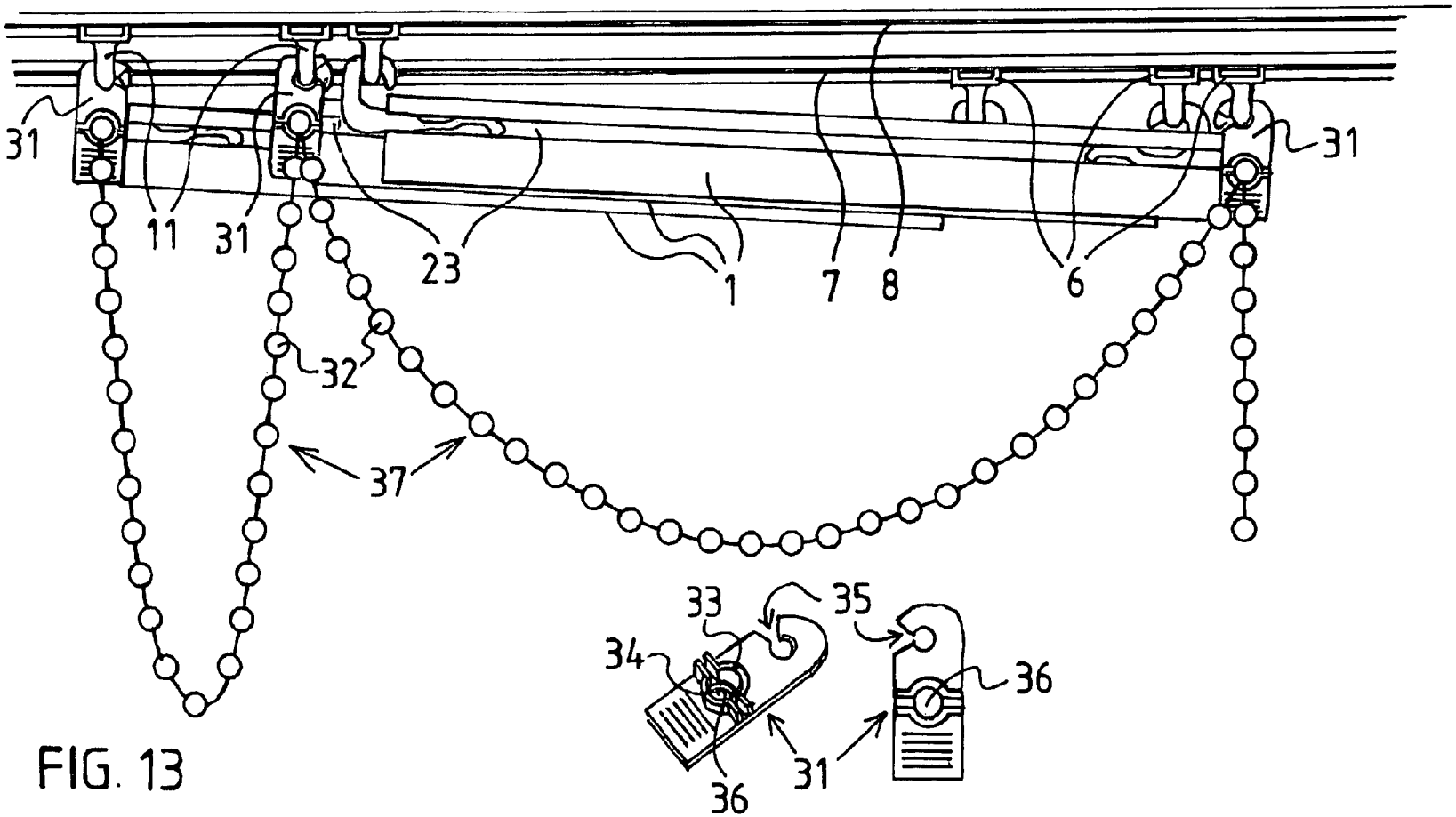

There are shown in:

FIG. 1: the curtain system with two parallel rail runs of an assembly rail with four flat panels, assembled on a ceiling of a room;

FIG. 2 the end of a horizontal slat with a hook as a fastening means for hanging on a slider;

FIG. 3 the end of a horizontal slat with a hook for hanging on a roller arbor;

FIGS. 4-10 various variants of insert grooves or insert sleeves with the corresponding insert elements, shown in section on the end-faces of a horizontal slat;

FIG. 11 an insert element of spring steel with the associated slat in the form of an aluminium profile, as well as a slide and the associated rail run above this, all represented in a perspective view;

FIG. 12 the insert element of spring steel with the associated slat of FIG. 11, seen from the side, with the hung slide and inserted into the slat from the end-face;

FIG. 13 three hanger rods for curtain panels assembled on a rail with two rail runs, with a pull chain connecting them.

DETAILED DESCRIPTION OF THE DRAWING FIGURES AND PREFERRED EMBODIMENTS

A curtain system is shown in its application in FIG. 1. It includes an assembly rail with two rail runs 7, 8 which are assembled on a ceiling 12 of a room, and which in the shown example serve for the displaceable hanging of four flat panels 9. Instead of on the room ceiling, the assembly rail may also be arranged on a board arranged lower or itself form such a board. The rail runs may also be located in a round rod. The two rail runs 7, 8 are here laid running parallel to one another and at a small distance to one another, and running parallel to the upper edge of the room. Each curtain panel 9 consists of a panel carriage with a slat 1 of metal, wood or plastic, and a piece of curtain material hung thereon. A hollow seam at the upper edge of the curtain material advantageously serves for the hanging of the curtain material on the slat 1. The curtain with this hollow seam may then be simply pushed over the slat 1. It then hangs freely downwards and forms a flat panel 9. So that the curtain material hangs with hardly any folds, the lower seam in the known manner may be provided with tensioning weights, such as with a weight rod pushed into the lower hollow seam. The slat 1 on which the curtain material hangs is provided at its ends on both sides with fastening means 4 which in each case include a hook which each may be hung on an eyelet 11 of a slider 6 which slides in a rail run, or on the arbor of each roller pair which rolls in the inside of the rail runs 7, 8. Here in each case the left ends 2 of the slats 1 with their fastening means 4 are hung on the sliders 6 which slide in the front rail run 7 facing the observer. The respective the right ends 3 of the slats 1 on the other side, with their fastening means 4 are hung on the sliders 6 which slide in the rail run 8 of the assembly rail, said rail run being at the rear and distant to the observer. As a result of this arrangement, the individual panels 9 are compelled to hang at a slightly oblique angle with regard to the running direction of the rail runs 7, 8 and of the room wall or window wall running behind the curtain. With a panel width for example of 0.5 m and a distance of the rail runs 7, 8 from rail run middle to rail run middle of for example 2 cm, there results an angle of merely 2.3° to the running direction of the rail runs. As an example four panels 9 are drawn in. With this, the middle two hang in a position in which they overlap by a third. A gap of about a third of the panel width remains free between the outer two panels 9 and the two middle panels 9. All panels 9 may be moved to and fro along the rail runs 7, 8 and the shown position of the panels 9 is merely selected in order to indicate the setting possibilities. For example all panels 9 may be pushed completely to the left or to the right until they overlap one another and their slats 1 with the curtain materials hanging therefrom abut one another. The panels 9 may be pushed together in a complete or only loose manner at any position lying between the two end locations. By way of this free displaceability up to the overlapping with the adjacent panel, many possibilities are available for effects with light. The curtain panels may also be easily displaced so that for example a window arranged behind it when required may be opened or a balcony or terrace door may be opened and thus a passage to the outside is made possible. A pull-cord provided with additional sliders may serve for this, wherein these sliders are hung between the sliders 6 of the slats 1 in one of the two rail runs 7, 8. The pull-cord with each of its sliders grips and displaces in each case one panel 9 and may be also provided with a pull rod on at least one of its ends.

In FIG. 2, here the left end 2 of a slat 1 is represented with fastening means 4 and the slider 6. The fastening means 4 here consists of a shape piece, such as of plastic or metal which from the end-face 19 with an insert element 18 may be inserted into a corresponding recess 23 of the slat 1 and into this. It is important that the fastening means 4 is not shaped thicker or wider than the slat 1 itself so that the slats 1 which later run at a slightly oblique angle to the curtain rail 7, 8 may be completely pushed onto one another and the distance of the slats 1 is not limited by the fastening means 4. The fastening means 4 shown here to the top forms a hook 10. This may be hung into an eyelet 11 of a slide piece 6. The slide piece runs in the rail run of the curtain rail in a conventional manner. The eyelet 11 and the hook 10 are formed sufficiently wide so that the fastening means 4 is pivotable about the vertical axis with respect to the rail run 7, 8 in which it is hung over the slider 6. The end 15 of the hook 10 comes so close to the end of the slat 1 that the remaining clear width is smaller than the thickness of the eyelet 11 and by way of this, it may no longer fall out of the hook 10. Furthermore the curtain material which at its upper end comprises a hollow seam may be pulled over the slat 1 and after this may be pulled out over its end so that the initial region of the hollow seam comes to lie in the region below the hook 10. In the shown example the hollow seam of a curtain panel is indicated. This hollow seam at its outer end is provided with a cut so that a small stitching 29 is formed, by which means the upper outer corner forms a tiny pocket 30. If the hollow seam is pushed over the slat 1 completely to the left, then this pocket comes to lie over the upper corner, here the left one of the slat 1, and is pushed over the corner of the slat 1 here which indeed forms a shoulder 16. This shoulder 16 which is formed by the upper slat corner then act as a barb for the curtain material and ensures that this may not slip back out of the slat 1. Exactly the same applies to the other side of the hollow seam and the slat 1.

FIG. 3 shows an alternative fastening means 4. This is likewise inserted into the slat by way of an insert element 18 from the end-face into a recess 23 in the slat 1. This fastening means 4 however is shaped differently and comprises a hook 10 which includes a longer neck 17 or an upwardly projecting part. The hook 10 is open obliquely to the bottom and is dimensioned such that it may be hung on the connection arbor 13 between the two associated rollers 5. The roller pair 5 is introduced into the rail run of a curtain rail in which it rolls along in the longitudinal direction of the rail run.

Figure 5:
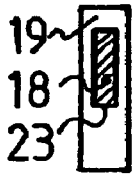
Figure 6:
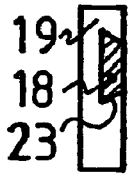
Figure 7:
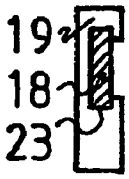
Figure 8:
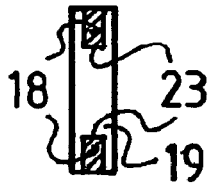
Figure 9:
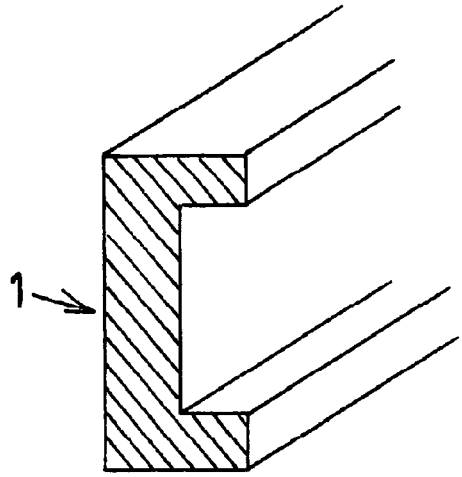
Figure 10:
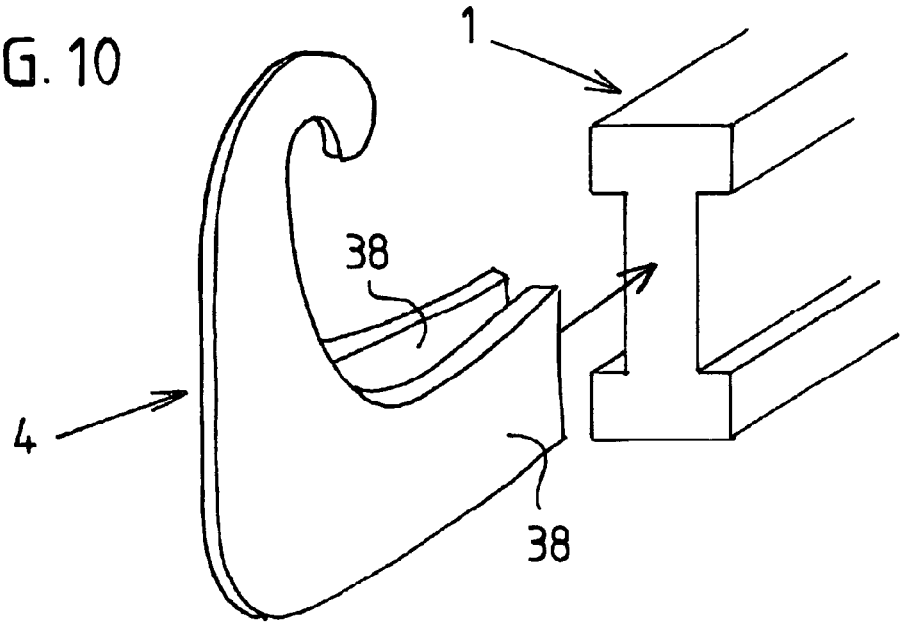

FIGS. 4 to 10 show various embodiments of end-faces 19 for the slats 1. The slats 1 in FIG. 4 at the end-face comprise two insert sleeves 22 into which corresponding insert pins 18 on the fastening means 4 may be inserted. In FIG. 5 at the end-face one may recognise a recess 23 which is rectangular in cross section, and into which an associated insert element may be inserted. In FIG. 6, the recess 23 is designed as a groove which is trapezoidal in cross section and which is open at its short trapezoid side, which means it forms a groove on the slat 1 which is swallowtail in cross section, into which an insert element 18 may be inserted from the end-face of the slat. In FIG. 7 the recess 23 is again rectangular and is arranged in the inside of the slat 1 but is open with a smaller width on the one side of the slat 1. In FIG. 8 the slat 1 above and below in each case comprises an open insert groove 23 into which corresponding rectangular profile sections 18 on the fastening means 4 fit. FIG. 9 shows one variant of the slat 1 with a laterally recessed groove of a rectangular cross section and FIG. 10 finally shows yet a further slat with grooves each of a rectangular cross section recessed on both sides. A fork-like fastening means 4 may be inserted via these two grooves, whose fork prongs 38 are resilient and have a certain bias so that the inserted fork is clamped in the grooves.

FIG. 11 shows a particularly advantageous embodiment example of the curtain system, wherein here only the one end of a slat 1 is shown. This slat 1 is an aluminium profile of 2.4 mm thickness and 17 mm width, which is manufactured with the extrusion method and as a recess 23 comprises a laterally open insert groove 23 of about more than 1 mm depth with a swallowtail shaped cross-section as already shown in FIG. 6. The fastening means 4 here are formed at both ends of the slat 1 by an insert element 18 of spring steel of for example approx. 0.7 mm thickness which has a shape as is shown in the Figure. This insert element 18 is a punched part which is therefore inexpensively manufacturable. Furthermore a single special slider 6 is shown which is known under the trade name Clic-slider and which may also be used for conventional curtains. Its eyelet 11 is pushed over the hook 10 on the fastening means 4, or the hook 10 is hung on the eyelet 11. This Clic-slider 6 as a speciality, on both sides comprises elastically downwardly pivotable locking lips 26 so that it may be inserted from below at any location through the slot 28 of the rail run of the associated curtain rail 7 into inside of this. With this the locking lips 26 are temporarily pivoted downwards and after passing the slot edges they pivot back in an elastic manner and at the same time lock the slider 6 in the rain run of the curtain rail 7. Proceeding from the situation represented, however firstly the fastening means 4 is hung with the hook into the slider eyelet 11 and then with the slider 6 attached thereto, as indicated by the arrow, is pushed from the end-face of the slat 1 into the insert groove 23. This is effected amid a slight elastic curvature of the insert element 18 of spring steel, by which means an increased sliding friction at the edges of the groove arises. If the insert element 18 is pushed so far into the insert groove 23 as is shown in FIG. 12 in which it is wedged in this as a results of its increasing height to the rear, the tip 15 of the hook end is located approximately at the height of the profile end or the end-face of the slat 1. Thus it is ensured that the eyelet 11 of the slider 6 may not slip from the hook 10. The hook 10 may however still be laterally pivoted within the eyelet 11, and specifically to each side by approx. 45°. The insert element 18 is now held in the insert groove 23 by way of adhesive friction. This adhesive friction is significantly increased by way of the acting spring force of the insert element 18 with which this is spread apart in the insert groove 23. The adhesive friction force produced is so large that the insert element 18 is held securely in the groove. For assembly of the curtain panels thus firstly an insert element 18 with the slider 6 in the shown manner is inserted into the insert groove 23 at the one end of the slat 1 from the end-face. Thereafter the slat 1 is inserted through the hollow seam 27 of an associated curtain material 9. Subsequently at the other end of the slat 1 in the same manner, an insert element 18 with slider 6 is inserted. Thereafter the slat 1 together with the curtain material 9 by way of the slider 6 may be clicked into the two distanced rail runs 7, 8. It is recommended to shape the hollow seam about 2.7-3.0 cm high so that the complete material panel may be stripped away very simply from the hanger rod together with hook and slider element and after washing may again be pushed again over the hanger rod.

FIG. 13 shows three slats 1 whose one end in each case hangs on a slider 6 in a rail run 7, and whose other end in the same manner hangs on a second rail run 8. This figure helps to understand how the individual slats 1 cooperate. For this reason they are represented here without the curtain panel, and specifically in a view from the window into a room. The grooves 23 in the slats 1 here therefore face the window so that from the room one may neither see the grooves 23 nor the parts of the insert elements 18 which are inserted in them. Additionally here pull elements 31 are yet hung on the eyelets of the sliders 6. Two such pull elements 31 are represented separately below the figure and in an enlarged scale. It is the case of plastic platelets with a hook which comprises a tapering opening 35 so that such a pull element 31 may be clipped over the eyelet 11 of a slider 6 amid the slight spreading of the upper hook limb and is securely held thereon. Furthermore two roughly semicircular shells 33, 34 are integrally formed on this platelet 31 which may be spread apart somewhat in an elastic manner, and a hole 36 lies between these two shells 33, 34, which go through the platelet. A small ball 32 of a chain 37 may be clipped between these two shells 33, 34 so that this ball is firmly clamped between these two shells 33, 34. A ball chain 37 with small balls 32 which are seated on a cord which passes through them in the shown manner may then connect the individual slats 1 of a curtain arrangement to one another. The slat 1 which is located to the very right in the picture is the slat on the end-side there. A pull element 31 on which a chain 37 with the small balls 32 is fastened is attached to the outer end of this slat. The chain 37 afterwards is led to the ulterior end of the subsequent slat 1 and here in the same manner is firmly clipped onto a hung pull element 31. From here the chain 37 leads further to the ulterior end of the next subsequent slat 1 and again in the same manner is firmly clipped on a hung pull element 31. If further slats 1 follow, then the chain 37 would always be hung on their ulterior ends. For opening or for sliding aside the finished panel curtain, the chain 37 may be gripped at its end which here is on the right in the picture and is pulled to the left in the picture. At the same time the left slider of the first slat 1 located at the very right in the picture abuts the left slider of the subsequent, here middle slat 1 and this slider 6 finally abuts on the slider 6, here at the left, of the slat 1 which is located at the very left in the picture, etc. For the renewed shutting of the panel curtain, the chain 37 at its end which is on the right here is pulled in the direction to the right. It is then tensioned bit by bit and pulls the subsequent slat 1 from its ulterior end to the right in the picture. The chain length between two fastening points is advantageously selected such that with a tensioned chain the panels or slats 1 overlap somewhat. Then a pleasant light effect results in the panels.

For assembly of such a panel curtain—if conventional sliders 6 without locking lips or roller pairs are used—the individual slats 1 with the panels hanging thereon with their end-side hooks 10 are firstly hung on the eyelets 11 of the sliders 6 or the hooks may be hung on the roller arbors 13. In this condition then a slat 1 is gripped and is pivoted downwards roughly in the plane of the panel to be created. Thereafter the upper slider or the upper roller pair in a conventional manner in the region of the end of a rail run 8 of a curtain rail is introduced through an opening located there, on the underside of the rail runner into the inside of this, and is displaced therein by a distance of the length of the slat 1 therein. Then the slat 1 is pivoted back upwards again about the eyelet 11 of the upper slider or about the arbor 13 of the upper roller pair and the second slider or the second roller pair is introduced into the other rail run 7.

The invention claimed is:

1. A curtain system, comprising:

a plurality of flat panels made of a laminar material with each flat panel of said plurality of flat panels having, at its upper end, a hanger rod formed as a horizontal slat on which said laminar material freely hangs on a plurality of hollow seams, each said horizontal slat including recesses, holes or grooves opening into an end-face;

rollers or sliders;

a first common rail;

a second common rail;

means for fastening said rollers or sliders to said horizontal slat, wherein said rollers or sliders of a first end region of each said horizontal slat are guided in said first common rail and said rollers or sliders of a second end region of each said horizontal slat are guided in said second common rail, so that said plurality of flat panels are pushable over one another, said means for fastening said rollers or sliders comprising insert elements from which each said end-face, or side thereof, is insertable into the recesses, holes or grooves of each said horizontal slat.

2. The curtain system according to claim 1, wherein said insert elements do not laterally project beyond each said horizontal slat nor an imagined continuation of each said horizontal slat, so that two adjacent flat panels of said plurality of flat panels hang on two rain runs and are pushable over one another to a sufficient extent so that associated said horizontal slats having said plurality of hollow seams of said laminar material bear on one another in a tight manner.

3. The curtain system according to claim 1, wherein said means for fastening said rollers or sliders to said horizontal slat includes self-clamping insert elements formed as punched parts or spring steel which, from an end-side or a side thereof, are insertable into recesses in an associated said horizontal slat.

4. The curtain system according to claim 1, wherein said means for fastening said rollers or sliders to said horizontal slat includes a hook hung on an eyelet or an associated said slider.

5. The curtain system according to claim 4, wherein said means for fastening said rollers or sliders to said horizontal slat include a plurality of hooks having a geometry such that with said means for fastening being inserted into one said horizontal slat, a clear width exists between an end of each hook of said plurality of hooks and an associated said horizontal slat, the clear width being smaller than a thickness of said eyelet on said associated said slider.

6. The curtain system according to claim 5, wherein said means for fastening said rollers or sliders to said horizontal slat includes at least one insert element fitted via an adhesive friction into at least one corresponding insert sleeve or recess on said end-face of said associated said horizontal slat.

7. The curtain system according to claim 1, wherein said means for fastening said rollers or sliders to said horizontal slat includes a hook hung on a connection arbor of two associated said rollers.

8. The curtain system according to claim 1, wherein said means for fastening said rollers or sliders to said horizontal slat includes insert connections insertable into holes or recesses in said end-face of said first end region and said second end region of said horizontal slat, wherein said holes or recesses from said end-face are recessed from said plurality of said horizontal slats and with flanks of said plurality of horizontal slats being untouched and remaining free to said first end region and said second end region of said plurality of horizontal slats.

9. The curtain system according to claim 8, wherein said means for fastening said rollers or sliders to said horizontal slat includes at least one insert element fitted via an adhesive friction into at least one corresponding insert sleeve or recess on said end-face of said associated said horizontal slat.

10. The curtain system according to claim 1, wherein said means for fastening said rollers or sliders to said horizontal slat includes a plurality of hooks having a geometry that permits said means for fastening said rollers or sliders to be insertable into said end-face of each said horizontal slat and with a shoulder at said first end region and said second end region of each said horizontal slat, so that a hollow seam of said plurality of hollow seams has a corner pocket that is pushable over said shoulder and is secured by said shoulder to avoid slippage back onto an associated said horizontal slat.

11. The curtain system according to claim 10, wherein said means for fastening said rollers or sliders to said horizontal slat includes at least one insert element fitted via an adhesive friction into at least one corresponding insert sleeve or recess on said end-face of said associated said horizontal slat.

12. The curtain system according to claim 1, further comprising:

pull elements formed as platelets hang onto eyelets of said sliders; and, means for clipping-in a ball of a ball chain, so that a plurality of said pull elements can be connected with a tensile, non-positive fit with said ball chain.

13. The curtain system according claim 1, wherein each said hollow seam of said plurality of hollow seams has, at two upper corners of each said hollow seam, a pocket that is pushable over an upper corner of an associated said horizontal slat.

14. The curtain system according to claim 1, wherein each said horizontal slat is made of metal.

15. The curtain system according to claim 1, wherein each said horizontal slat is made of wood.

16. The curtain system according to claim 1, wherein each said horizontal slat is made of plastic.

* * * * *